US007210947B1

(12) United States Patent
Fodero et al.

(10) Patent No.: US 7,210,947 B1
(45) Date of Patent: May 1, 2007

(54) CABLE HARNESS SYSTEM, GROUND CLIPS AND METHOD FOR ELECTRICALLY GROUNDING A CONDUCTOR OF THE CABLE HARNESS SYSTEM

(75) Inventors: Kenneth J. Fodero, Pullman, WA (US); James R. Kesler, Pullman, WA (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 0 days.

(21) Appl. No.: 11/331,979

(22) Filed: Jan. 13, 2006

(51) Int. Cl.
*H01R 4/66* (2006.01)

(52) U.S. Cl. ..... 439/95; 439/610

(58) Field of Classification Search ..... 439/95, 439/96, 97, 98, 610
See application file for complete search history.

(56) References Cited

U.S. PATENT DOCUMENTS 5,267,878 A * 12/1993 Shinji et al. ..... 439/610
5,315,063 A * 5/1994 Auclair ..... 174/78
6,217,381 B1 * 4/2001 Kameyama ..... 439/578
6,230,406 B1 * 5/2001 Balfour et al. ..... 29/863
6,437,245 B1 * 8/2002 Hayashi ..... 174/74 R
6,595,789 B2 * 7/2003 Oota et al. ..... 439/98
6,669,511 B1 * 12/2003 Yagi et al. ..... 439/610

* cited by examiner

*Primary Examiner*—Thanh-Tam Le
(74) *Attorney, Agent, or Firm*—Cook, Alex, McFarron, Manzo, Cummings & Mehler, Ltd.

(57) ABSTRACT

A cable harness system includes a cable having a number of individual conductors, and a connector to enable conductive coupling of the cable to a device. The connector includes an electrically conductive connector body configured for attachment to a chassis of the device. The cable harness system also includes a ground clip to facilitate an electrical ground path between one of the individual conductors and the chassis of the device. The ground clip includes a first portion configured for conductive coupling to the conductor, and a second portion configured for conductive contact with the connector body. The ground clip may be configured as a ground clip lug captured by a captive screw member compressively securing the ground clip lug against the connector body. The ground clip may also be a ground clip bracket configured for frictional engagement with the connector body.

31 Claims, 6 Drawing Sheets

CABLE HARNESS SYSTEM, GROUND CLIPS AND METHOD FOR ELECTRICALLY GROUNDING A CONDUCTOR OF THE CABLE HARNESS SYSTEM

CROSS-REFERENCE TO RELATED APPLICATIONS

None

BACKGROUND OF THE INVENTION

The present invention generally relates to electrically grounded connectors, and more specifically, to a cable harness system, ground clips and a method for electrically grounding a conductor of the cable harness system.

Electric power systems are designed to generate, transmit and distribute electrical energy to loads. In order to accomplish this, power systems generally include a variety of power system elements such as electrical generators, electrical motors, power transformers, power transmission lines, buses and capacitors, to name a few. As a result, power systems typically include protective devices and associated procedures to protect the power system elements from abnormal conditions such as electrical short circuits, overloads, frequency excursions, voltage fluctuations, and the like.

Electric power systems also require communication and computer networks. For example, Supervisory Control and Data Acquisition (SCADA) systems are included to measure the voltages associated with a power system substation bus (i.e., bus voltages), to measure the current coming into the bus from a power transmission line (i.e., a line current), and to measure the status or position of numerous switches in the substation. The status measurements may include indications of circuit breaker positions and electrical power routing switch positions (e.g., open position, closed position). The SCADA system may also be configured to transmit the current, voltage and switch position measurements to a central control center (CC) via a SCADA communication network for review by an operator. The operator can then make decisions such as closing a circuit breaker to enable additional electric power to a particular load. In that case, a command from the operator delivered via the SCADA communication network results in closure of the circuit breaker.

Such communication and computer networks include the use of cabling, connectors and associated grounding methods. As a result, equipment manufacturers in the power system industry are engaged in manufacturing the cable/connector assemblies supporting the communication and computer networks. One typical method for manufacturing and connecting a cable having a number of conductors (e.g., a multi-conductor cable used with a DB-9 connector) includes stripping and soldering one of the cable conductors, designated as a ground wire, directly to a conductive shell, or body, of an associated connector. Besides being somewhat labor intensive, electrical grounding via use of a solder connection to the connector shell limits the type of conductor shells that can be used. Alternatively, another method for grounding a cable having a number of conductors includes use of metal backshells configured to provide grounding from the wire to the case. Unfortunately, such metal backshells are expensive and often labor intensive and complicated to assemble.

SUMMARY OF THE INVENTION

In accordance with an aspect of the invention, a cable harness system includes a cable having a number of individual conductors, and a connector to enable conductive coupling of the cable to a device. The connector includes an electrically conductive connector body configured for attachment to a chassis of the device. The cable harness system also includes a ground clip to facilitate an electrical ground path between one of the individual conductors and the chassis of the device. The ground clip includes a first portion configured for conductive coupling (e.g., a connection barrel having a bore formed therein) to the conductor, and a second portion configured for conductive contact (e.g., a contact flange) with the connector body.

In accordance with another aspect of the invention, a ground clip facilitates an electrical ground path between a conductor of a number of individual conductors of a cable and an electrically conductive connector body of a connector. The connector body is attached to a chassis of a device. The ground clip includes a first portion configured to conductively couple to the conductor, and a second portion configured to conductively contact with the connector body. The ground clip may be configured as a ground clip lug captured by a captive screw member compressively securing the ground clip lug against the connector body. The ground clip may also be a ground clip bracket configured for frictional engagement with the connector body.

In accordance with a further aspect of the invention, a method facilitates an electrical ground path between a conductor of a number of individual conductors of a cable and an electrically conductive connector body of a connector. The connector body is attached to a chassis of a device. The method includes conductively coupling the conductor to a ground clip via a first portion of the ground clip, and conductively connecting the second portion of the ground clip to the connector body. The method also includes securing the ground clip against the connector body.

It should be understood that the present invention includes a number of different aspects and/or features which may have utility alone and/or in combination with other aspects or features. Accordingly, this summary is not an exhaustive identification of each such aspect or feature that is now or may hereafter be claimed, but represents an overview of certain aspects of the present invention to assist in understanding the more detailed description that follows. The scope of the invention is not limited to the specific embodiments described below, but is set forth in the claims now or hereafter filed.

DETAILED DESCRIPTION OF THE INVENTION

Figure 1:
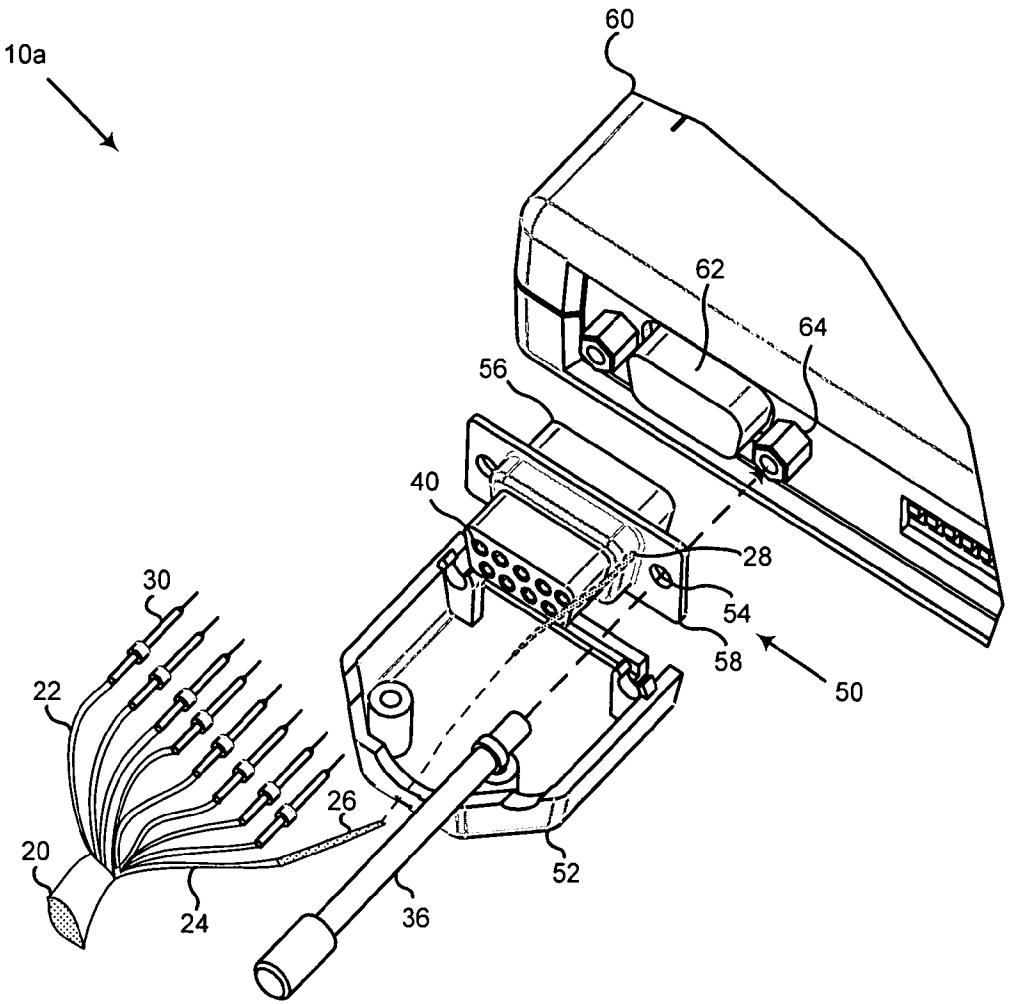
FIG. 1 (PRIOR ART)
FIG. 1 is an exploded view of a typical cable harness system including a cable that is electrically grounded via a solder joint between an individual conductor of the cable and a grounded electrically conductive connector body.

FIG. 1 is an exploded view of a typical cable harness system 10*a* including a cable 20 that is electrically grounded via a solder joint 28 between an individual conductor 26 of the cable and a grounded conductive connector body 56 of a connector 50. The cable 20 includes a number of individual conductors 22. One of the individual conductors, illustrated as conductor 24, is partially stripped of its insulation to expose its conductive material (e.g., wire). The remaining conductors 22 are fitted with respective conductor contacts 30 to enable easy insertion into connector contact holes 40 of the connector 50.

In addition to the cable 20, the typical cable harness system 10*a* includes a backshell 52 configured to house an extending portion of the connector 50 that includes the connector contact holes 40. An opening in the backshell 52 accommodates placement of the cable 20 when the conductor contacts 30 are inserted into respective connector contact holes 40. Although only a bottom portion is shown, it should be understood that the backshell 52 includes a corresponding top portion.

The conductive connector body 56 includes a connector flange 58 having dual device attachment holes 54 formed therein. The dual device attachment holes 54 in the connector flange are positioned to enable alignment and retainment of the connector 50 to its corresponding connection mate 62 on a device chassis 60.

In the illustrated example, a captive screw member 36, also know as a jackscrew, is inserted through a respective dual device attachment hole 54 and then screwed into a corresponding threaded nut 64 on the device chassis 60, thereby compressively securing the connector 50 to the device chassis 60. The cable 20 is therefore electrically grounded via the solder joint 28 between the stripped conductor 26 in contact with the conductive connector body 56 secured to the device chassis 60. While providing an effective electrical ground path, construction of the solder joint is labor intensive and time consuming. In addition, the step of constructing the solder joint may not fit well within an associated manufacturing process.

Figure 2A:
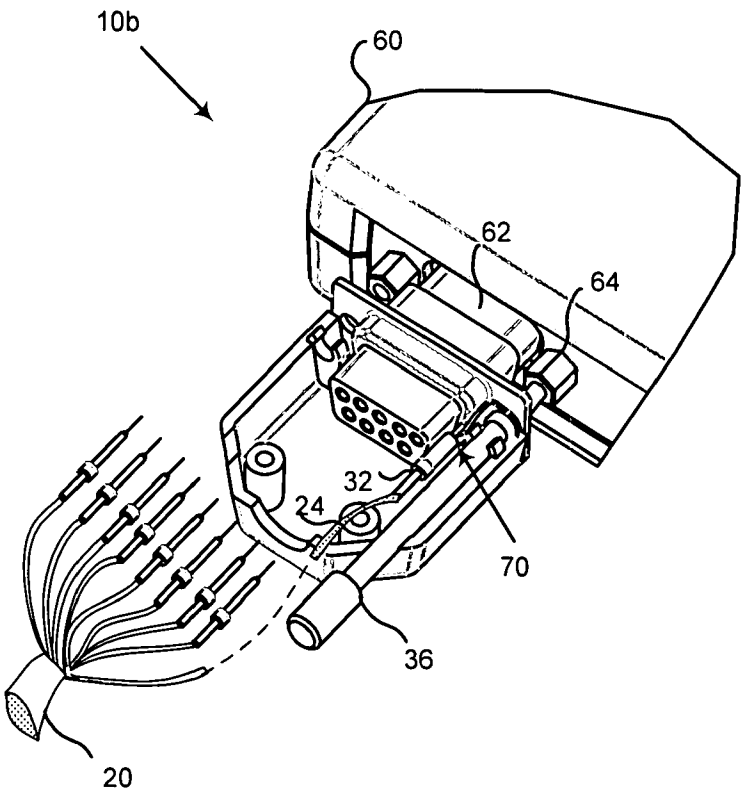
FIG. 2A is a perspective view of a cable harness system including a cable grounded via a connector contact conductively connecting an individual conductor of the cable to a conductive ground clip lug, according to an embodiment of the invention.
Figure 2B:
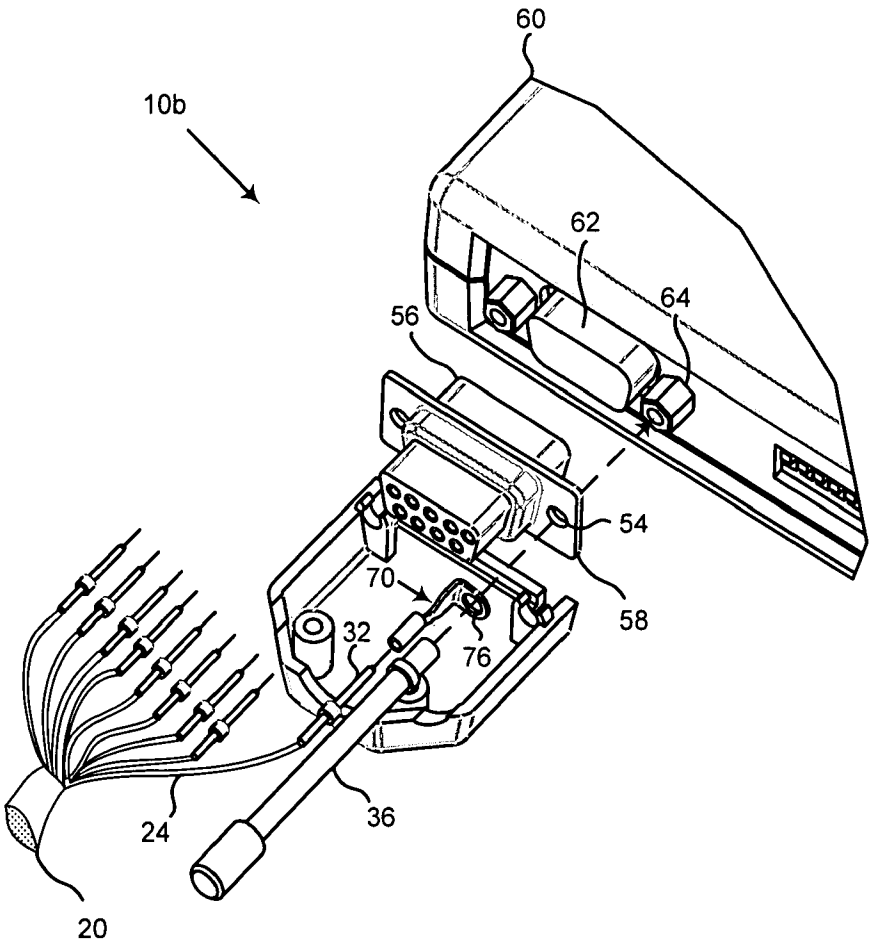
FIG. 2B is an exploded perspective view of the cable harness system of FIG. 2A, according to an embodiment of the invention.

FIG. 2A is a perspective view of a cable harness system 10*b* including the cable 20 grounded via the connector contact 32 conductively coupling an individual conductor 24 to a conductive ground clip lug 70, according to an embodiment of the invention. FIG. 2B is an exploded perspective view of the cable harness system 10*b* of 2A. The ground clip lug 70 facilitates electrical grounding of the cable 20 without the solder joint 28 of FIG. 1. Although illustrated using a DB9 connector and associated cable, it is contemplated that the ground clip lug 70 may be used with other connectors and cables.

Referring to FIGS. 2A and 2B, the ground clip lug 70 includes a first portion configured for electrically conductive coupling to the conductor 24, and a second portion configured for electrically conductive contact with the conductive connector body 56. Although preferably connected via a crimped connection, the conductor 24 may also be connected to the first portion of the ground clip lug 70 via a soldered connection.

Figure 3A:
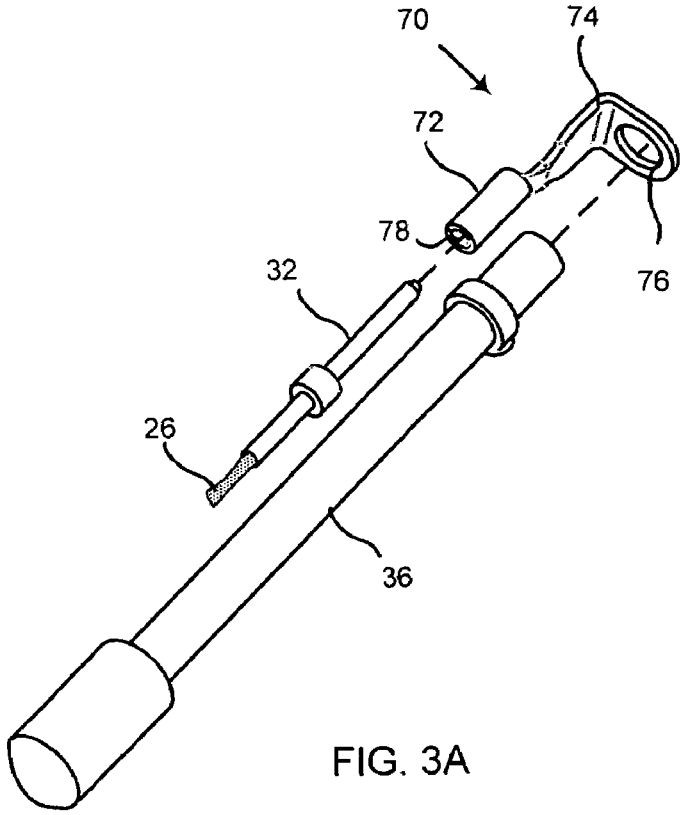
FIG. 3A is a detailed exploded view showing the connector contact conductively connecting the individual conductor to the ground clip lug of the cable harness system of FIGS. 2A and 2B.

FIG. 3A is a detailed exploded view showing the connector contact 32 conductively coupling the conductor 26 to the ground clip lug 70 of FIGS. 2A and 2B. Referring to FIG. 3A the first portion of the ground clip lug 70 includes a connection barrel 72 having a bore 78 formed therein. The bore 78 is sized to receive the connector contact 32. The second portion of the ground clip lug 70 includes a contact member, in the illustrated example, a contact flange 74 having a flange opening 76 formed therein. The flange opening 76 is preferably sized and threaded to receive the captive screw member 36.

The conductor 26 is conductively connected to a first end of the connector contact 32 using a solder connection or a crimped connection. A second end of the connector contact 32, which may be configured as a male or female contact, is preferably held within the bore 78 via a friction fit. The second end of the connector contact 32 may also be held within the bore 78 via a solder connection or a crimped connection.

Figure 3B:
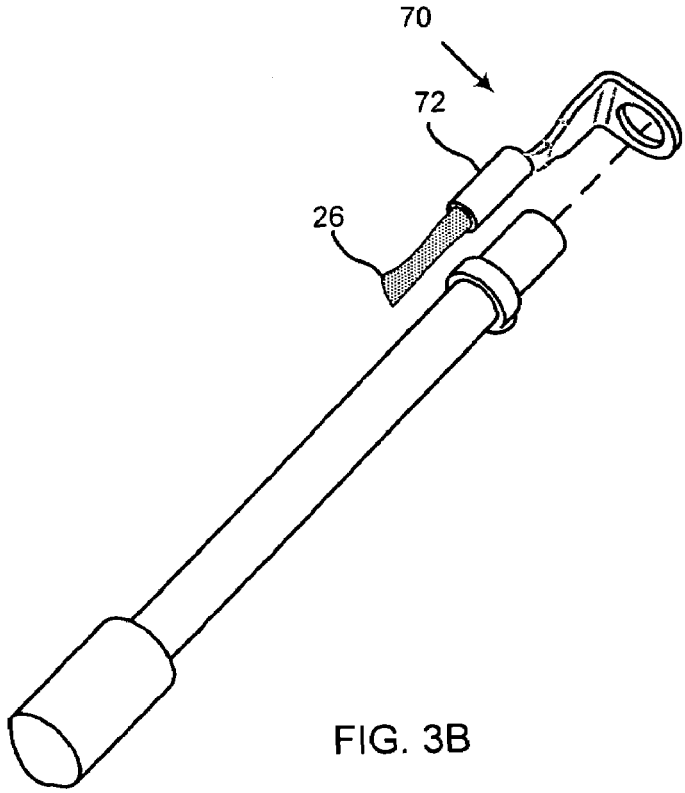
FIG. 3B is detailed exploded view showing the individual conductor directly connected to the ground clip lug, according to another embodiment of the invention.

In some cases, it may be advantageous to insert the conductor 26 directly into the bore 78. FIG. 3B is detailed exploded view illustrating the conductor 26 directly connected to the ground clip lug 70, according to another embodiment of the invention. Although preferably held within the bore 78 via a crimped connection, the conductor 26 may be held via a soldered connection.

Figure 4:
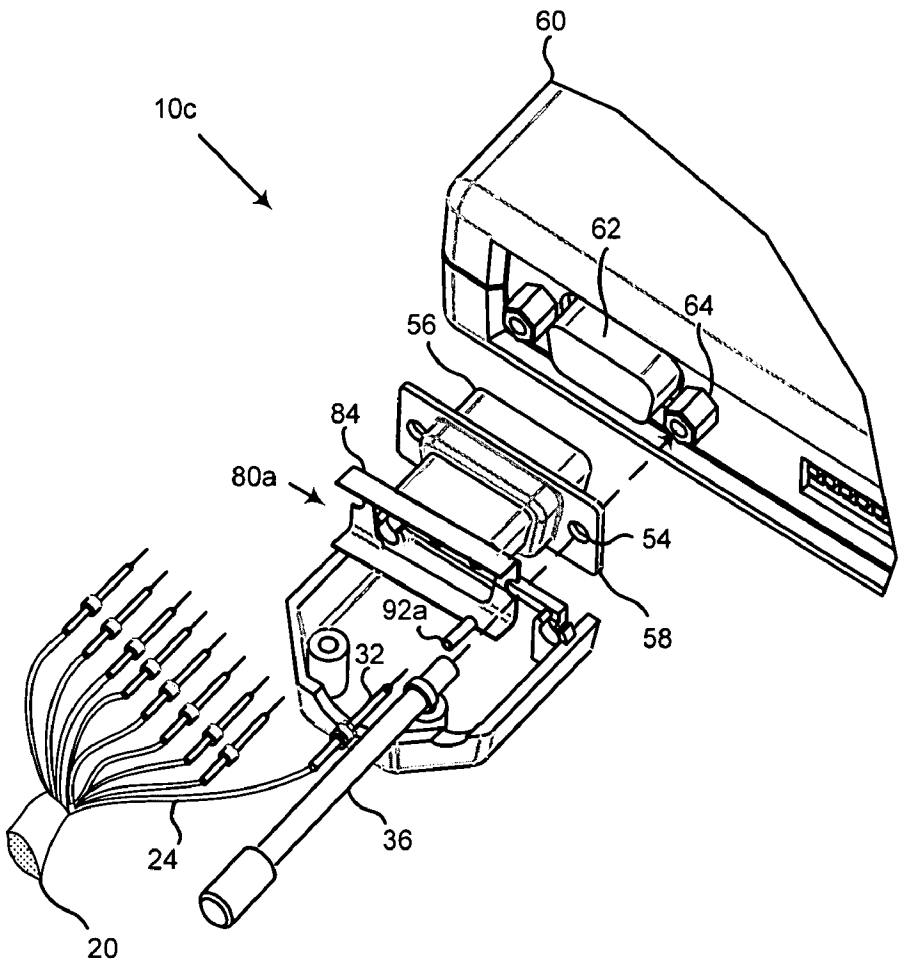
FIG. 4 is an exploded perspective view of another cable harness system including a cable grounded via a connector contact conductively connecting an individual conductor of the cable to a conductive ground clip bracket, according to an embodiment of the invention.

FIG. 4 is an exploded perspective view of another cable harness system 10*c* including the cable 20 grounded via the connector contact 32 conductively connecting the conductor 24 to a conductive ground clip bracket 80*a*, according to an embodiment of the invention. The ground clip bracket 80*a* facilitates electrical grounding of the cable 20 without the solder joint 28 of FIG. 1. Although illustrated using a DB9 connector and associated cable, it is contemplated that the ground clip bracket 80*a* may be used with other connectors and cables.

The ground clip bracket 80*a* includes a first portion configured for electrically conductive coupling to the conductor 24, and a second portion configured for electrically conductive contact with the conductive connector body 56. Although preferably connected via a connector contact 32, a crimped connection, the conductor 24 may also be connected to the first portion of the ground clip bracket 80*a* via a soldered connection.

Figure 5A:
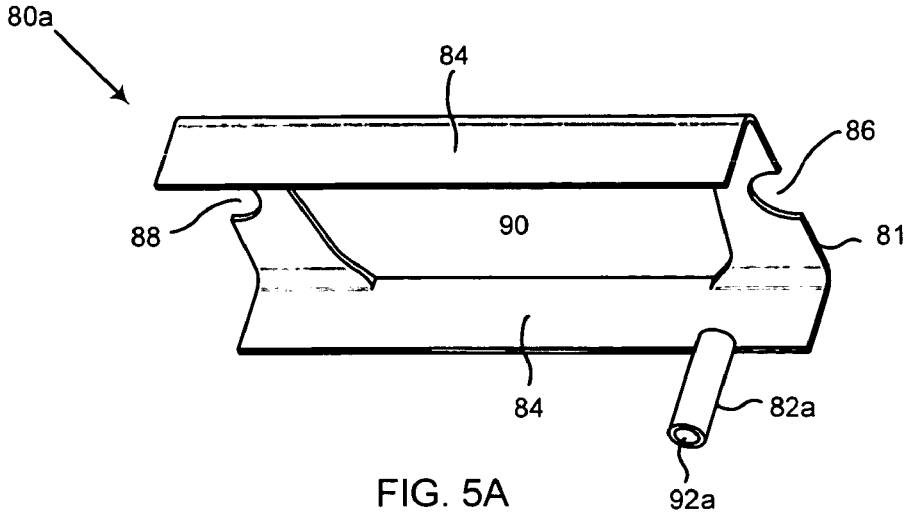
FIG. 5A is a perspective view of the ground clip bracket of FIG. 4.

FIG. 5A is a perspective view of the ground clip bracket 80*a* of FIG. 4. Referring to FIG. 5A the first portion of the ground clip bracket 80*a* includes a connection barrel 82*a* having a bore 92*a* formed therein. The connection barrel 82*a* is substantially similarly configured and operable as described in connection with the connection barrel 72 of FIGS. 3A and 3B. The bore 92*a* is sized to receive either the connector contact 32 or the conductor 24 as described in connection with FIGS. 3A and 3B. The second portion of the ground clip bracket 80*a* includes a contact member, in this case, a pair of arms 84 extending from opposing edges of a bracket base 81. As illustrated, the connection barrel 82*a* is preferably disposed on an edge of one of the pair of extending arms 84, proximate to an end, to facilitate receipt of either the conductor 26 or the connector 32.

The bracket base 81 includes an opening 90 formed therein to accommodate insertion of an extending portion of the connector 50. Each of the pair of arms 84 is inclined towards the other arm to frictionally engage the extending portion of the connector 50 in order to enable electrical grounding of the cable when the connector body 56 is conductively attached to the device chassis 60. Optionally included in the bracket base 81 is a pair of apertures 86, 88 configured to permit used of a corresponding pair of captive screw members 36 to compressively secure the connector body 56 against the device chassis 60.

Figure 5B:
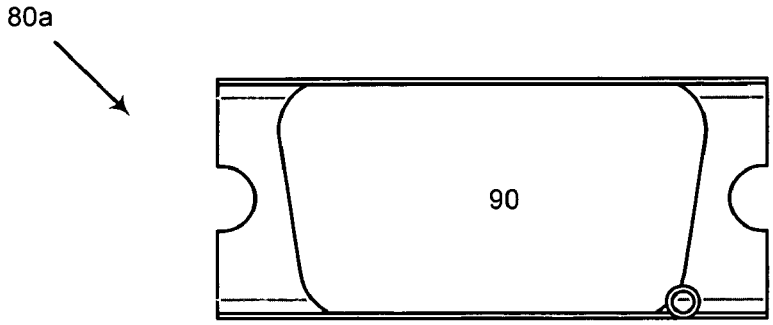
FIG. 5B is a front view of the ground clip bracket of FIG. 4.
Figure 5C:
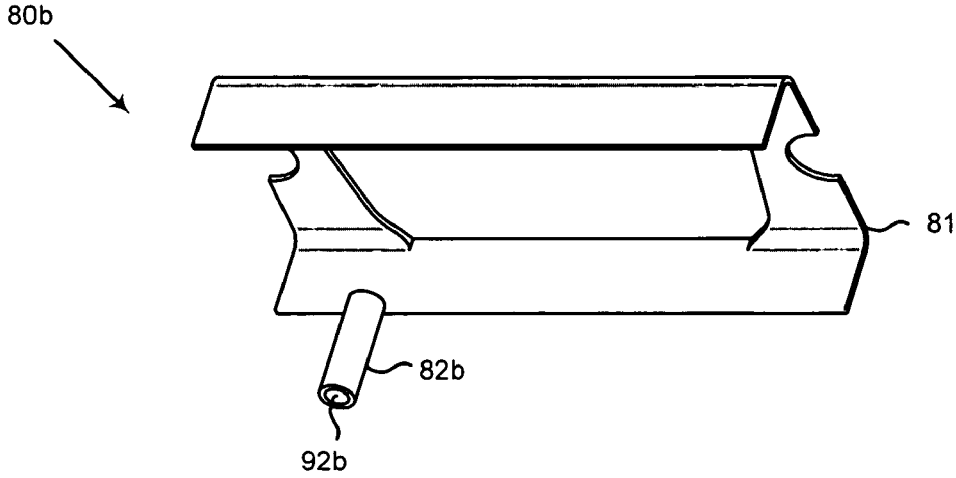
FIG. 5C is a perspective view of another embodiment of the ground clip bracket of FIG. 4.

FIG. 5B is a front view of the ground clip bracket 80*a*. FIG. 5C is a perspective view of another embodiment of a ground clip bracket 80*b* where the connection barrel, in this case connection barrel 82*b*, is disposed proximate to another end of the edge of one of the pair of extending arms 84. Although two configurations of the ground clip bracket are shown, it is contemplated that other configurations may be used to provide a "solderless" ground path.

Figure 6:
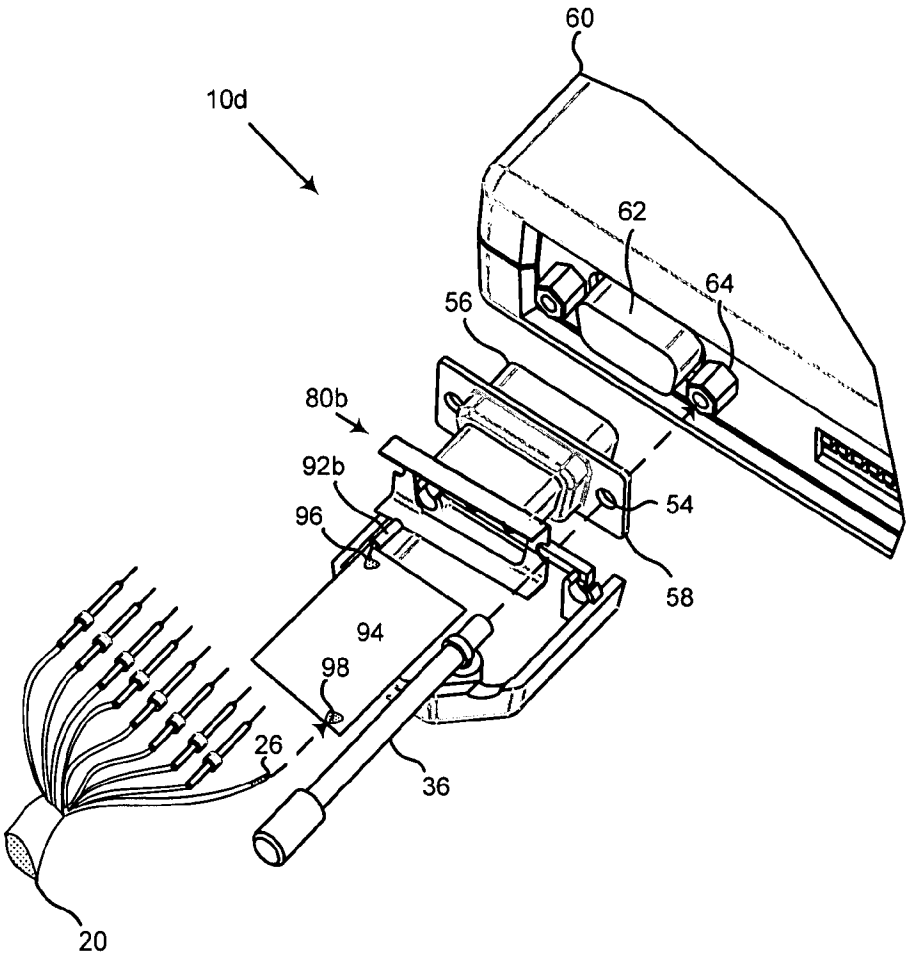
FIG. 6 is an exploded perspective view of yet another cable harness system including a cable grounded via a printed circuit board conductively connecting an individual conductor of the cable to the ground clip bracket, according to an embodiment of the invention.

In some applications, it may be desirable to utilize a printed circuit board in the cable harness. Such applications may include cables used in signal processing applications such as those that adapt between communication standards. FIG. 6 is an exploded perspective view of yet another cable harness system 10*d* including the cable 20 grounded via a printed circuit board 94 conductively coupling the conductor 26 to the ground clip bracket 80*b*, according to a further embodiment of the invention. Although illustrated using the ground clip bracket 80*b*, it is contemplated that other configuration of ground clips may also be used. The printed circuit board 94 includes a first terminal 98 configured to conductively connect to the conductor 26, and a second terminal 96 configured for insertion into the bore 92*b* of the connection barrel 82*b*. The first and second terminals 98, 96 are conductively coupled such that when the conductor 26 is connected to the first terminal 98, it is electrically grounded via the second terminal 96 and the connector body 56 to the device chassis 60. The second terminal is connected to the ground clip using one of a soldered connection, a crimped connection and a friction fit connection.

While this invention has been described with reference to certain illustrative aspects, it will be understood that this description shall not be construed in a limiting sense. Rather, various changes and modifications can be made to the illustrative embodiments without departing from the true spirit, central characteristics and scope of the invention, including those combinations of features that are individually disclosed or claimed herein. Furthermore, it will be appreciated that any such changes and modifications will be recognized by those skilled in the art as an equivalent to one or more elements of the following claims, and shall be covered by such claims to the fullest extent permitted by law.

What is claimed is:

1. A cable harness system comprising:

a cable including a number of individual conductors;

a connector configured to enable conductive coupling of the cable to a device, the connector including an electrically conductive connector body configured for attachment to a chassis of the device;

the bore configured to facilitate an electrical ground path between a conductor of the number of individual conductors and the chassis of the device, the ground clip including a first portion configured for conductive coupling to the conductor, and a second portion configured for conductive contact with the connector body;

wherein the first portion of the ground clip includes a connection barrel having a bore formed therein, and wherein the second portion of the ground clip includes a contact member; and a connector contact conductively coupling the conductor to the ground clip, the connector contact including a first end configured to connect to the conductor, and a second end configured to connect to the bore.

2. The cable harness system of claim 1, wherein the conductor is connected to the first portion of the ground clip using one of a soldered connection and a crimped connection.

3. The cable harness system of claim 1, wherein the ground clip comprises a ground clip lug, and wherein the contact member comprises a contact flange having a flange opening formed therein.

4. The cable harness system of claim 3, further comprising a captive screw member configured for insertion into the flange opening and a device attachment hole of the connector body, the captive screw member threadedly engaging the device to compressively secure the contact flange against a surface of the connector body and to compressively secure the connector body against the chassis of the device to enable electrical grounding of the cable.

5. The cable harness system of claim 1, wherein the ground clip comprises a ground clip bracket, and wherein the contact member comprises a pair of arms extending from opposing edges of a base of the ground clip bracket and inclined towards each other.

6. The cable harness system of claim 5, wherein the bracket base includes an opening formed therein to accommodate insertion of a conductive extending portion of the connector, the pair of arms frictionally engaging the extending portion to enable electrical grounding of the cable when the connector body is attached to the chassis of the device.

7. The cable harness system of claim 5, further comprising a captive screw member configured for insertion through a device attachment hole of the connector body, the captive screw member threadedly engaging the device to compressively secure the connector body against the chassis of the device.

8. The cable harness system of claim 1, wherein the bore is configured to receive the conductor.

9. The cable harness system of claim 1, wherein the conductor is connected to the first end of the connector contact using one of a soldered connection and a crimped connection.

10. The cable harness system of claim 1, wherein the second end of the connector contact is connected to the ground clip using one of a soldered connection, a crimped connection and a friction fit connection.

11. The cable harness system of claim 1, wherein the second end of the connector contact is one of a male contact and a female contact.

12. The cable harness system of claim 1, further comprising a printed circuit board conductively coupling the conductor to the ground clip, the printed circuit board including a first terminal configured to conductively connect to the conductor, and including a second terminal configured for insertion into the bore.

13. The cable harness system of claim 12, wherein the second terminal is connected to the ground clip using one of a soldered connection, a crimped connection and a friction fit connection.

14. A ground clip to facilitate an electrical ground path between a conductor of a number of individual conductors of a cable and an electrically conductive connector body of a connector, the connector body attached to a chassis of a device, the ground clip comprising:

a first portion configured to conductively couple to the conductor;

a second portion configured to conductively contact with the connector body;

wherein the first portion of the ground clip includes a connection barrel having a bore formed therein, and wherein the second portion of the ground clip includes a contact member; and wherein the conductor is conductively coupled to the ground clip via a connector contact, the connector contact including a first end configured to connect to the conductor and a second end configured to connect to the bore.

15. The ground clip of claim 14, wherein the conductor is connected to the first portion of the ground clip using one of a soldered connection and a crimped connection.

16. The ground clip of claim 14, wherein ground clip is configured as a ground clip lug, and wherein the contact member comprises a contact flange having a flange opening formed therein.

17. The ground clip of claim 16, wherein a captive screw member is configured for insertion into the flange opening and a device attachment hole of the connector body, the captive screw member threadedly engaging the device to compressively secure the contact flange against a surface of the connector body and to compressively secure the connector body against the chassis of the device to enable electrical grounding of the cable.

18. The ground clip of claim 14, wherein ground clip is configured as a ground clip bracket, and wherein the contact member comprises a pair of arms extending from opposing edges of a base of the ground clip bracket and inclined towards each other.

19. The ground clip of claim 18, wherein the bracket base includes an opening formed therein to accommodate insertion of a conductive extending portion of the connector, the pair of arms frictionally engaging the extending portion to enable electrical grounding of the cable when the connector body is attached to the chassis of the device.

20. The ground clip of claim 18, wherein a captive screw member is configured for insertion into a device attachment hole of the connector body, the captive screw member threadedly engaging the device to compressively secure the connector body against the chassis of the device to enable electrical grounding of the cable.

21. The ground clip of claim 14, wherein the bore is configured to receive the conductor.

22. The ground clip of claim 14, wherein the ground clip is connected to the second end of the connector contact using one of a soldered connection, a crimped connection and a friction fit connection.

23. The ground clip of claim 14, wherein the conductor is conductively coupled to the ground clip via a printed circuit board, the printed circuit board including a first terminal configured to conductively connect to the conductor and a second terminal configured for insertion into the bore.

24. The ground clip of claim 23, wherein the ground clip is connected to the second terminal using one of a soldered connection, a crimped connection and a friction fit connection.

25. A method for facilitating an electrical ground path between a conductor of a number of individual conductors of a cable and an electrically conductive connector body of a connector, the connector body attached to a chassis of a device, the method comprising:

conductively connecting a first end of a connector contact to the conductor; conductively coupling the conductor to a ground clip;

wherein the ground clip comprises a ground clip lug, the first portion of the ground clip including a connection barrel having a bore formed therein, and the second portion of the ground clip including a contact flange having a flange opening formed therein;

conductively connecting a second end of the connector contact to a ground clip, the ground clip including a first portion and a second portion; and securing the ground clip against the connector body.

26. The method of claim 25, further comprising soldering or crimping the first portion of the ground clip to the connector.

27. The method of claim 25, wherein:

the step of conductively connecting the first end of the connector contact to the conductor comprises one of soldering and crimping; and the step of conductively connecting the second end of the connector contact to the ground clip comprises one of soldering, crimping, friction fitting, and combinations thereof.

28. The method of claim 25, further comprising:

conductively connecting a first terminal of a printed circuit board to the conductor using one of a soldered connection and a crimped connection; and conductively connecting a second terminal of the printed circuit board to the ground clip using one of a soldered connection, a crimped connection, and a friction fit connection.

29. The method of claim 25, wherein the ground clip lug is secured against the connector body using a captive screw member, the captive screw member inserted into the flange opening and a device attachment hole of the connector body and threadedly engaging the device to compressively secure the connector body against the chassis of the device to enable electrical grounding of the cable.

30. The method of claim 25, wherein the ground clip comprises a ground clip bracket including a pair of arms extending from opposing edges of a base of the ground clip bracket and inclined towards each other.

31. The method of claim 30, wherein the base includes an opening formed therein, and wherein the pair of arms frictionally engages an extending portion of the connector body to enable electrical grounding of the cable when the connector body is attached to the chassis of the device.

* * * * *